US006925845B2

(12) United States Patent
Behrens et al.

(10) Patent No.: US 6,925,845 B2
(45) Date of Patent: Aug. 9, 2005

(54) METHOD AND DEVICE FOR TENSION LEVELING A COLD-ROLLED STRIP AND REGULATING THE DEGREE OF LEVELING

(75) Inventors: Holger Behrens, Erkrath (DE); Hans Georg Hartung, Pulheim (DE); Ralf Ulrich, Düsseldorf (DE); Bernd Kreft, Willich (DE); Stefan Melster, Erkrath (DE); Bodo Falkenhahn, Düsseldorf (DE); Andreas Gramer, Solingen (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/362,488

(22) PCT Filed: Aug. 1, 2001

(86) PCT No.: PCT/EP01/08873

§ 371 (c)(1),
(2), (4) Date: Feb. 20, 2003

(87) PCT Pub. No.: WO02/16057

PCT Pub. Date: Feb. 28, 2002

(65) Prior Publication Data

US 2004/0020258 A1 Feb. 5, 2004

(30) Foreign Application Priority Data

Aug. 24, 2000 (DE) ..... 100 41 563

(51) Int. Cl.[7] ..... B21D 1/05

(52) U.S. Cl. ..... 72/161; 72/205

(58) Field of Search ..... 72/160, 161, 164, 72/205

(56) References Cited

U.S. PATENT DOCUMENTS

| | | | | | |
|---|---|---|---|---|---|
| 2,526,296 | A | * | 10/1950 | Stone | 72/164 |
| 3,374,653 | A | * | 3/1968 | Zeigler | 72/161 |
| 3,924,428 | A | * | 12/1975 | Noe | 72/40 |
| 5,182,931 | A | * | 2/1993 | Noe et al. | 72/183 |
| 5,704,237 | A | | 1/1998 | Noe et al. | |
| 6,109,084 | A | * | 8/2000 | Hutzenlaub et al. | 72/205 |
| 6,240,762 | B1 | * | 6/2001 | Kan et al. | 72/161 |

FOREIGN PATENT DOCUMENTS

EP 0 393 301 10/1990

* cited by examiner

*Primary Examiner*—Daniel C. Crane
(74) *Attorney, Agent, or Firm*—Herbert Dubno

(57) ABSTRACT

The invention relates to a method for tension levelling a cold-rolled strip, whereby the strip passes through a series of break rolls and a series of traction rolls and in the course of its extension is subjected to traction between the two series of rolls. The strip is bent under traction in a series of high-traction rolls, located between the brake roll and the traction roll series, in order to increase the degree of levelling. To achieve this, the series of high-traction rolls between the brake and the traction rolls has at least two traction rolls for generating the strip traction and bending operation.

4 Claims, 2 Drawing Sheets

METHOD AND DEVICE FOR TENSION LEVELING A COLD-ROLLED STRIP AND REGULATING THE DEGREE OF LEVELING

CROSS REFERENCE TO RELATED APPLICATIONS

This application is a national stage of PCT/EP01/08873 filed 1 Aug. 2001 and based, in turn, upon German national application 11041563.6 of 24 Aug. 2000 under the International Convention.

FIELD OF THE INVENTION

The invention relates to a method and a device for tension leveling of cold-rolled strip.

BACKGROUND OF THE INVENTION

A method and a stretch-bending device for the tension leveling of cold-rolled strip is known from U.S. Pat. No. 5,704,237.

Furthermore, from EP 0 393 301 B2 a method of continuously straightening metal strip under tension with a strip thickness between 0.05 and 0.5 mm, especially strip composed of steel, aluminum or like metals, has become known. There the strip to be subjected to tension leveling passes through a brake roll set, i.e. series of brake rolls, and through a tension roll set i.e. a series of tension rolls, and between the two roll sets in the course of stretching in the plastically deformable range is subjected to tension leveling at a tension which exceeds the elastic limit of the strip material or corresponds to the elastic limit of the strip material.

To reduce to a minimum the transverse changes to the strip resulting from stretching in the plastically deformable state to a minimum and to practically completely eliminate the formation of central dishing as well as residual stresses nonuniformly distributed over the strip width, such tension leveling apparatus has between the brake roll set and the traction roll set a tension leveling roll pair so that an additional stretching tension force is superimposed on the strip which effects a stretching in the range of plastic deformation. While the rolls of the brake roll set and the traction roll set bring about a relatively high degree of stretch, with the tension leveling roll pair only about 5 to 25% of the tension leveling is produced.

OBJECT OF THE INVENTION

The object of the invention is to provide a method for the purpose described for as well as a device for carrying out the method and in addition to enable a control of the degree of tension leveling with which the cold-rolled strip to be tension leveled is annealed, pickled and optionally stressed, so that the resulting strip will have improved qualities, especially an enhanced surface quality from the elastic and plastic stretching.

SUMMARY OF THE INVENTION

This object is achieved with a method according to the invention in which a further roll set is provided whereby the major part of the stretching tension is produced. A preferred feature is that the strip is subjected in the high traction roll set to alternate-direction bending. The invention utilizes the fact that with a bending of the strip under a superimposed traction, the resulting degree of tension leveling can be greater and that strip thicknesses of greater than 0.5 mm can be used to produce products of high surface quality, primarily from stainless steel but also from strip of such materials which are characterized by high surface quality, with enhanced planarity and reduction of the intrinsic stress state by tension leveling. The surface fineness and the surface brightness of the tension level metal strip is improved. The method of operating with alternate direction bending in the high traction roll set, which according to the invention produces the major component of the tension leveling, so that the remaining tension leveling is distributed to the braking roll set and the tractive roll set, allows the tension leveling to be further elevated.

In accordance with a proposal of the invention, the strip is plastically elongated by the superimposition of strip tension and bending at the point at which the strip runs onto the individual rolls of the high traction roll set and the point at which the strip runs off the individual rolls of the high traction roll set. In this manner a point symmetrical development of the bending is achieved in the high traction part, especially with thicker strip that cannot be stretched between the rolls by pure tension.

According to a further advantageous feature, the strip is passed through the high traction roll set with a short strain relief length between the respective run-on point and run-off point of the individual rolls. With this short strain relief length by which we mean a free unguided length of the strip between two rolls following one another in the strip travel, the strip travel is improved and the tendency of the strip to form longitudinal folds is reduced. The short strain relief length can be achieved, for example, in that the rolls which follow one another of the roll set in the direction in which they loop around the rolls or the strip level have a spacing from one another which is reduced by comparison with the spacing which is usually the case with S-roll arrangements.

A preferred feature provides that the degree of stretch is so controlled that in the further roll set disposed between the brake roll set and the traction roll set, the individual degrees of stretch at the run-on points and run-off points to the individual rolls is summed up to a total degree of stretch, whereby the degree of stretch externally of the roll set is detected between respectively the tension build up and straightening rolls or the straightening and tension reducing rolls of the brake and tractive roll set and fed back to control the torques of the rolls of the further roll set. Thus a speed differential between rolls is no longer required to obtain a certain degree of stretch downstream of two rolls but a more sensible distribution of the individual degrees of stretch can be achieved with this control.

The objects set forth are achieved according to the invention with a device which is characterized in that the further roll set provided between the braking and tractive roll sets comprises four traction rolls for generating the strip tension and bending. These rolls integrated in the roll set in an S-shape pattern do not require, by contrast to conventional stretch levelers, any bending cassettes and additional adjustment systems. They produce by the simultaneous superimposition of bending and tension the desired high degree of stretch on the strip, whereby a roll set having four rolls in addition can provide by the alternating bending a degree of stretch which is greater by an order of magnitude in this region with elevated tension.

An embodiment of the invention provides that the direction rolls of the high traction roll set have a diameter which is different from that of the rolls of the brake set and the traction roll set. By varying the roll diameter, a targeted adjustment of the speed difference can be set to influence the plastification of the strip and thus the degree of tension leveling which is attainable or adjustable. With a high traction roll set with four rolls, either only the two inner tension rolls or all four rolls can have roll diameters deviating from those of the remaining rolls, i.e. those of the brake and tension roll sets. When these high traction rolls have a smaller diameter by comparison with the remaining rolls, it is possible to attain a correspondingly greater resultant degree of tension leveling by bending of the strip with superimposed traction. The limits are defined by the possible detriment to the strip surface. With very sensitive strip surfaces, there is a minimum effect with clearly larger roll diameters, for example of 800 to 1500 mm.

Finally a control of the degree of stretch is proposed which is characterized in accordance with the invention in that in a high traction roll set arranged between the brake roll set and the tension roll set, the individual degrees of tension leveling at the run-on point and the run-off point to the individual high traction rolls is summed up to a summation tension leveling degree whereby the tension leveling degree externally of the high traction roll set between respectively tension build up and straightening or the straightening and tension dropping roll of the brake and tension roll sets is tapped off and fed back to control torque of the high traction rolls. It is thus no longer required to maintain a speed differential between the rolls to have the requisite degree of tension leveling downstream of two rolls, but rather this control approach allows a more sensible distribution of the individual degree of tension leveling to be obtained.

BRIEF DESCRIPTION OF THE DRAWING

Further details and advantages of the invention are obtainable from the following description of embodiments of the invention shown in the drawing. The drawing shows.

SPECIFIC DESCRIPTION

Figure 1:
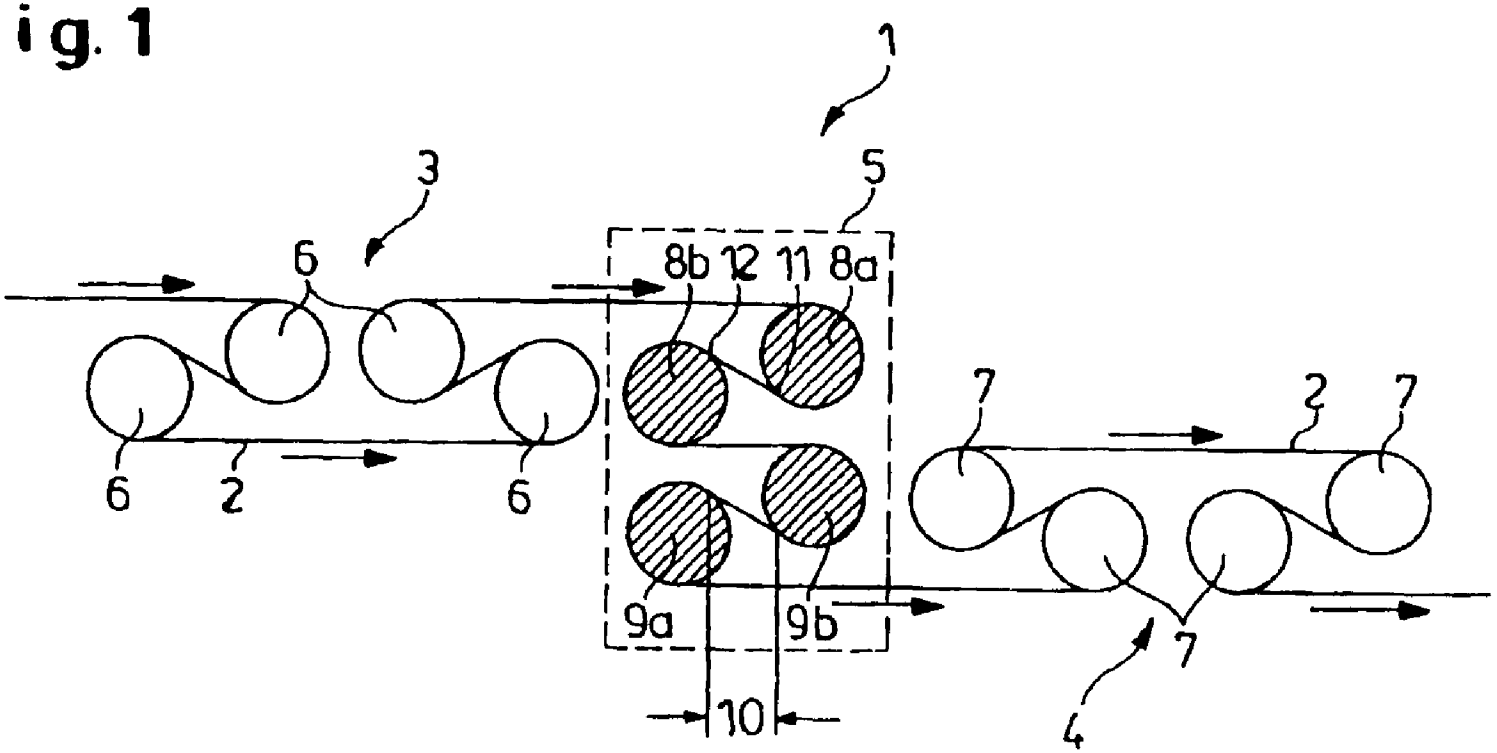
FIG. 1 in a highly schematic side view one embodiment of a tension leveling apparatus with an intermediate high traction part.

An apparatus 1 for the tension leveling of stainless steel strip 2, preferably with a thickness above 0.5 mm is comprised according to FIG. 1 of a brake roll set 3 and in the direction of the strip travel indicated by arrows and following the brake roll set 3, a high traction roll set 5 and a tension roll set 4. The brake roll set 3 is formed with four rolls 6 and the tension roll set 4 with four rolls 7, each of which is arranged pairwise in an S pattern. The high traction set 5 also has four rolls which also are arranged pairwise in an S pattern and respectively include the inner tension rolls 8*a* or 9*a* and the respective complementary rolls 8*b* or 9*b*.

The upper roll pair 8*a*, 8*b* and the lower roll pair 9*a*, 9*b* are spaced with reference to the individual rolls of the pairs mutually and from roll pair to roll pair at the minimum possible distances from one another. Short strain relief lengths 10 is thus provided between the runoff point 11 to the next following roll in the strip travel direction, whereby the strip travel is improved and the formation of longitudinal folds (handkerchief effect) is avoided. Since the strip 2 is subjected in the high traction roll set 5 to alternating bending—in which only one of the roll pairs provided in each case participates in a bending, an increased degree of stretch under tension occurs in the high stress roll set based on the bending of the strip under tension.

The bending of the strip 2 with superimposed tension results in a degree of stretch which is greater as the diameter of the rolls is smaller. The limit is at the roll diameter which, if made smaller, will disadvantageously have an adverse effect on sensitive strip surfaces, a significantly larger roll diameter, for example 800 to 1500 mm, reducing the influence on the strip surface. As is also determined by the selection of the roll diameter, in every case there is a plastic elongation of the strip 1 by a superimposition of strip tension and bending at the run-on point or run-off point 11, 12 of the rolls 8*a*, 8*b* or 9*a*, 9*b*.

Figure 2:
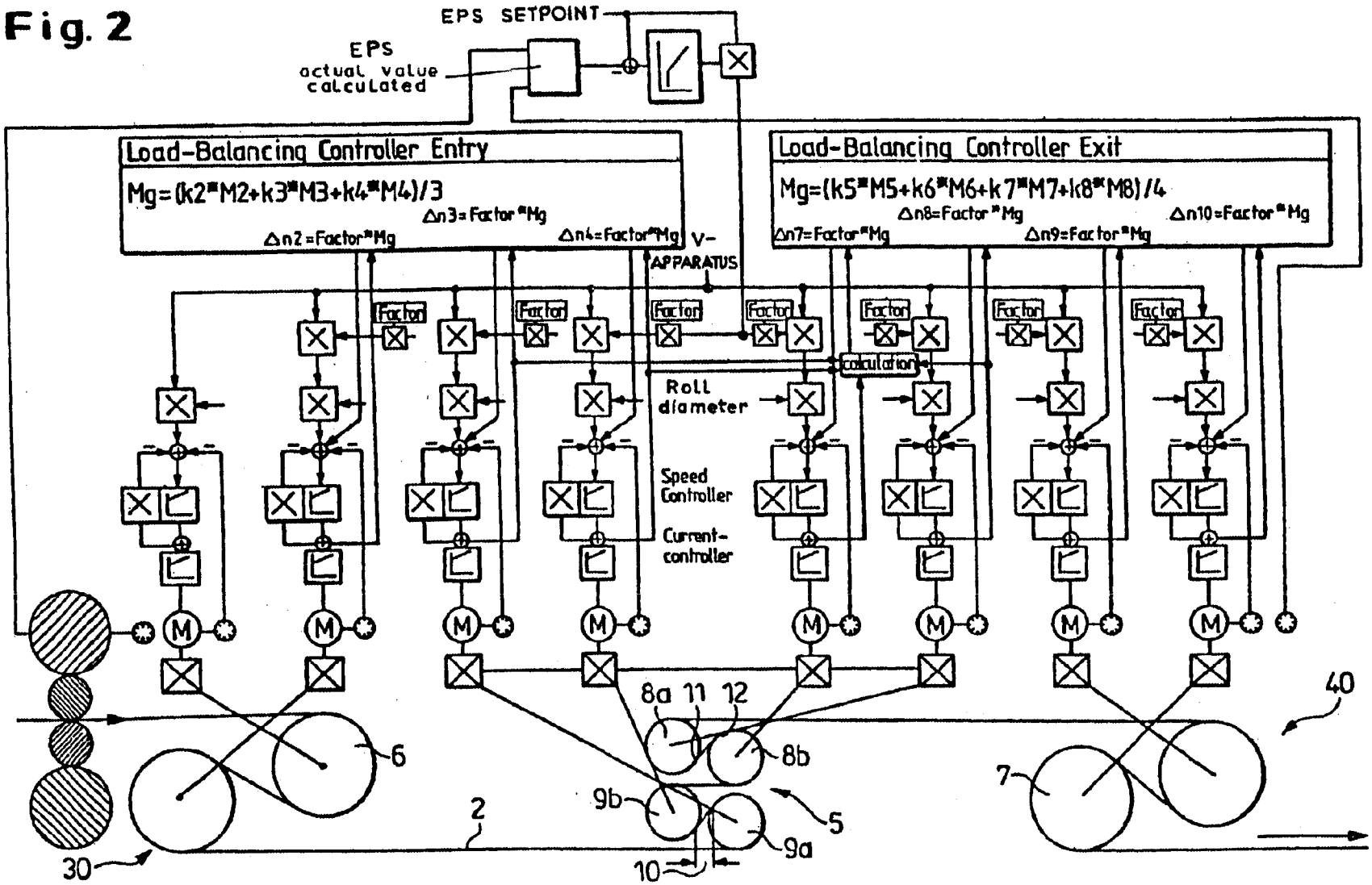
FIG. 2 a control diagram for regulating the degree of stretch with distribution of individual degrees of stretch.

As can be seen from the control diagram of FIG. 2 for the regulation of the degree of stretch of the stretch 2, as in the previously described example, a high traction roll set 5 is provided between the brake roll set 30 and the tension roll set 40. The brake and tension roll sets 30 and 40 are comprised here each only from one of the roll pairs formed by the rolls 6 or 7 whereby however the roll arrangement or the high traction set 5 again has a short destressing length 10 on the one hand and on the other ensures a bending with superimposed tension resulting in a high degree of stretch.

The illustrated control diagram enables the degree of stretch to be summed up to a total degree of stretch from the opposing influences on the individual degrees of stretch at the run-on and run-off points 11 or 12 of the rolls in the high traction roll set 5. A set point degree of stretch can thus be achieved with an appropriate precontrol and regulation of the individual torques. The degree of stretch outside the high traction roll set 5 is determined between the tension build up and straightening roll or the straightening and tension-reducing rolls of the brake tension roll sets 30 or 40 and the detected degree of stretch is fed back to regulate the torque of the rolls of the high traction roll set. A sensible distribution of the individual degrees of stretch is thereby possible.

What is claimed is:

1. A method of leveling cold-rolled strip, comprising the steps of:

passing the cold-rolled strip in succession through a brake roll set and a tension roll set and subjecting the strip between both roll sets to stretching under a stretching tension; and subjecting the strip between said roll sets to a bending to increase the degree of stretch in a further high-traction roll set arranged between the brake roll set and the traction roll set such that a major part of the stretching tension in the cold-rolled strip is produced by the further high-traction roll set, the degree of stretch being controlled in that individual degrees of stretch at run-on and run-off points of the individual rolls of the further roll set are summed up to a total degree of stretch, and a degree of stretch outside the further roll set is detected respectively in the brake roll set and the traction roll set and is fed back to control the torques of the rolls of the further high traction roll set.

2. The method according to claim 1, wherein the strip is subjected to an alternating direction bending in the further high traction roll set.

3. The method according to claim 1 wherein the strip is plastically elongated by superimposition of strip tension and bending at run-on points or run-off points, of the strip onto and off individual rolls of the further roll set.

4. The method according to claim 3 wherein the strip passes with short destressing lengths between the respective run-off and run-on points of the individual rolls of the high-traction roll set.

* * * * *